US005375303A

United States Patent [19]

Shenier

[11] Patent Number: 5,375,303

[45] Date of Patent: Dec. 27, 1994

[54] COVERED BUCKLE

[75] Inventor: Richard S. Shenier, East Williston, N.Y.

[73] Assignee: C & C Metal Products Corporation, Englewood, N.J.

[21] Appl. No.: 83,032

[22] Filed: Jun. 25, 1993

[51] Int. Cl.[5] ..... A44B 1/00; A44B 17/00

[52] U.S. Cl. ..... 24/163 FC; 24/92

[58] Field of Search ..... 24/163 FC, 90 C, 92, 24/113 R, 113 MP; 79/5

[56] References Cited

U.S. PATENT DOCUMENTS

| | | | |
|---|---|---|---|
| 2,008,267 | 7/1935 | Stollman | 24/163 FC |
| 2,599,225 | 6/1952 | Braegger | 24/92 |
| 2,602,975 | 7/1952 | Wolfe | 24/92 |
| 2,643,430 | 6/1953 | Koehl et al. | 24/163 |
| 2,654,927 | 10/1953 | Tansman | 24/92 |
| 2,798,389 | 7/1957 | Sackrider | 79/5 |
| 3,182,369 | 5/1965 | Lerma | 24/92 |
| 3,237,262 | 3/1966 | Decker | 24/163 FC |
| 3,452,402 | 7/1969 | Prym et al. | 24/75 |
| 3,934,314 | 1/1976 | Whysall | 24/113 R |
| 4,654,934 | 4/1987 | Hasegawa | 24/92 |
| 5,036,566 | 8/1991 | Kuhn et al. | 24/90 |

FOREIGN PATENT DOCUMENTS

| | | | |
|---|---|---|---|
| 267212 | 9/1964 | Australia . | |
| 1143598 | 10/1957 | France | 24/163 FC |
| 1168719 | 10/1969 | United Kingdom . | |

*Primary Examiner*—Victor N. Sakran
*Attorney, Agent, or Firm*—Klauber & Jackson

[57] ABSTRACT

A covered buckle comprises an upper annular member of inverted U cross-section into which is telescoped a lower annular member of U-shaped cross-section having a generally upstanding outer peripheral leg which either cants outwardly or is provided with an outwardly extending lip and an upstanding inner peripheral leg provided at its top with upstanding serrations to ensure adequate gripping and retention of even thin coverings.

10 Claims, 1 Drawing Sheet

COVERED BUCKLE

BACKGROUND OF THE INVENTION

Covered buckles of the prior art comprise an upper annular member having generally the cross-section of an inverted U with downwardly extending outer and inner peripheral legs and a lower annular member having generally the cross-section of a U with upstanding outer and inner peripheral legs. The upper member is covered with a flexible material. The lower member telescopes within the upper member and entrains the covering material. Generally, the outer upstanding leg of the lower member is provided with an outwardly extending lip. This lip not only causes gripping of the covering material but also ensures that when the outer depending leg of the upper member is bent inwardly, the upper and lower members interlock and the covered buckle is securely assembled. The inward deflection of the outer leg of the upper member causes such leg to become peripherally shortened, thickened and strengthened, increasing the secureness of the assembly. On occasion the inner upstanding leg of the lower member has been provided with an inwardly extending lip. However, the provision of such inwardly extending lip on the inner leg of the lower member is disadvantageous. When the inner depending leg of the upper member is deflected outwardly to concomitantly cause gripping of the covering and interlocking of the upper and lower members, such leg becomes peripherally elongated, thinned and weakened, and is readily subject to inward displacement by the relatively small forces which might be exerted by an errant fingernail. When this occurs, the grip on the covering material at the lip on the inner leg of the lower member becomes weakened. The prior art has also canted inwardly the generally upstanding inside leg of the lower member with equal disadvantage for the same reasons. However, if there is no such lip or cant, then the covering material is not strongly gripped. For thin coverings, the gripping is inadequate; and the covering is readily withdrawn or pulled from the inside periphery of the buckle.

SUMMARY OF THE INVENTION

One object of the invention is to provide a covered buckle having a lower member provided with an upstanding inner leg at the top of which are provided upstanding serrations.

Another object of the invention is to provide a covered buckle wherein the lower member is provided with an upstanding outer leg at the top of which is provided an outwardly extending lip.

A further object of the invention is to provide a covered buckle wherein the lower member is provided with a generally upstanding outer leg which is canted outwardly.

A still further object of the invention is to provide a covered buckle wherein the lower member is provided with an upstanding inner leg having upstanding serrations which project slightly above the plane or surface of the top of the outer leg.

Other and further objects of the invention will appear from the following description.

DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
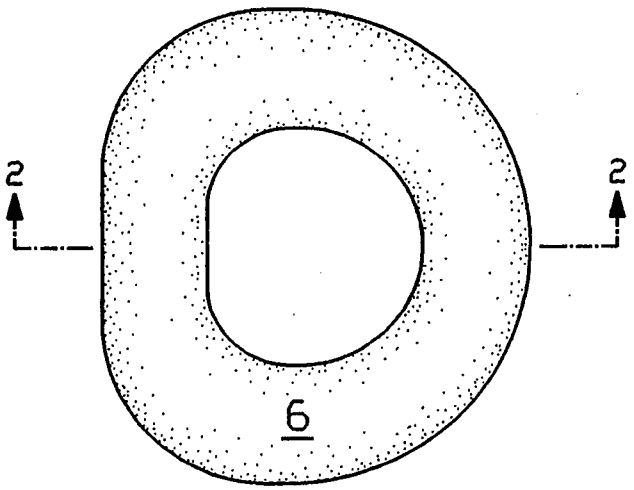
FIG. 1 is a top plan view of a covered buckle.

Referring now to the top plan view of FIG. 1, the covered buckle is shown as having a D-shape. Alternatively, the shape may be round, oval or that of a racetrack, for example. The straight portion of the D may have less width than the curved portion of the D. The width of the annulus between its inner and outer peripheries need not be constant as shown in FIG. 1. The covering material 6 is flexible and may be a plain woven fabric, a textured fabric such as velour or corduroy, or a layer of plastic or leather, either plain or textured, for example. Different coverings may have different thicknesses.

Figure 3:
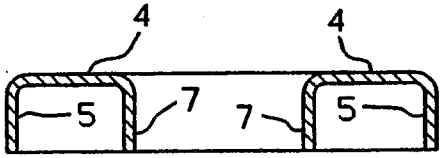
FIG. 3 is a sectional view on the same scale as FIG. 1 showing the upper member.

Referring now to FIG. 3, the upper member 4 is at least topologically annular, and has the cross-section of an inverted U including an outer peripheral depending leg 5 and an inner peripheral depending leg 7.

Figure 4:
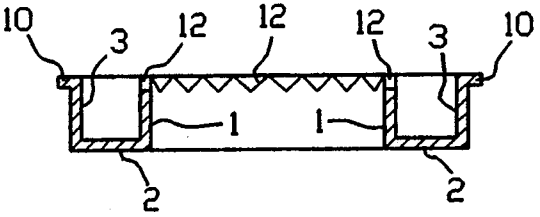
FIG. 4 is a sectional view on the same scale as FIG. 1 showing the lower member.

Referring now to FIG. 4, the lower member 2 is topologically annular and has the cross-section of a U including an outer peripheral upstanding leg 3 and an inner peripheral upstanding leg 1. At the top of the outer leg 3 is provided an outwardly extending lip 10. At the top of the inner upstanding leg 1 are provided serrations 12. The serrations 12 may have a symmetrical sawtooth waveform as shown. The tips of the teeth 12 are shown as being substantially in the plane or surface of the top of leg 3. The buckle may be curved as shown in Australian Patent 267,212 of Karl-Heinz Heimann, accepted May 9, 1966. In such event, the top of leg 3 would lie on a curved surface and not in a plane; and the tips of teeth 12 would also lie on such surface.

The amplitude or height from peak to trough of serrations 12 is of importance. If the height of the serrations is much less than the thickness of the covering, then there is insufficient penetration of the covering and a loss in gripping power. If the height of the serrations is much greater than the thickness of the covering, then there occurs a tendency to cause ripping of the covering. In general, the height of the serrations should be comparable to, or at least of the same order of magnitude as, the thickness of the covering to achieve adequate penetration while providing sufficient points of contact per linear inch to reduce localized shearing stress in the covering adjacent the points of contact. As a rule of thumb, it should be noted that the height of the serrations may also be comparable to, or at least of the same order of magnitude as, the outward extension of lip 10.

The covering 6 is laid over the top of upper member 4 and extends downwardly past the outer and inner legs 5 and 7. The lower member 2 is brought upwardly to telescope within the upper member 4 until lip 10 and teeth 12 seat the covering 6 against member 4. Then the outer peripheral leg 5 of the upper member is bent inwardly to maintain the upper and lower members 2 and 4 in their fully telescoped position and to cause gripping of covering 6 by lip 10 and serrations 12.

Figure 2:
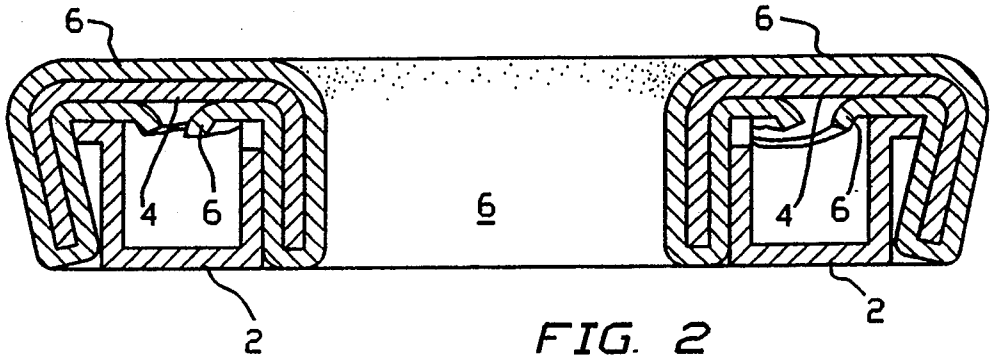
FIG. 2 is a sectional view on an enlarged scale taken along the line 2—2 of FIG. 1.

FIG. 2 shows the construction of the assembled buckle comprising upper member 4 covered by covering material 6 which is engaged by lower member 2. Where the buckle is curved, the top and bottom surfaces of the covered buckle will not be parallel, but will instead be concentric. The top and bottom surfaces of the covered buckle need not be parallel to one another but may instead be angled as shown in U.S. Pat. No. 5,036,566 issued to Kuhn et al on Aug. 6, 1991. For example, the straight portion of the D may have less height than the curved portion of the D. If the buckle is also curved, the surfaces of the top and bottom of the buckle would be curved but no longer concentric.

Figure 5:
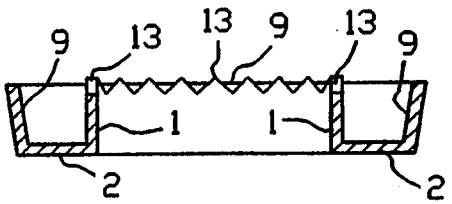
FIG. 5 is a sectional view on the same scale as FIG. 1 showing an alternate embodiment of the lower member.

Referring now to FIG. 5, there is shown an alternate construction of lower member 2. The outer leg 9 of the lower member, while generally upstanding, also cants outwardly at a small angle. This outward cant of leg 9 in FIG. 5 may be substantially equal to the outward extension of lip 10 from leg 3 in FIG. 4. Also, the peaks of serrations 13 at the top of the inner leg 1 extend slightly above the plane or surface of the top of outer leg 9. This ensures a better gripping of the covering 6. Preferably the lower member 2 is formed of a rigid metal such as steel so as to hold its shape during assembly of the covered buckle. Preferably the upper member 4 is made of a malleable or ductile material such as aluminum in approximately a half-hard temper. During the course of assembly of the covered buckle, there may occur slight distortions of the top of the upper member 4. If, for example, the inner portion of the top 4 deflects downwardly relative to the outer portion of top 4, then the covering 6 will be penetrated by teeth 12 even if they do not extend above the plane or surface of the top of outer leg 3. The provision of teeth 13 which extend slightly above the plane or surface of the top of outer leg 9 (or the top of outer leg 3) ensures that teeth 13 penetrate the covering without distortion of the original shape of the top of upper member 4. The projection of teeth 13 above the surface of the top of the outer leg, 9 or 3, should lie in the range from approximately one-half to approximately one-tenth the amplitude or height of the serrations, and preferably between one-third and one-fifth the amplitude thereof. If the serrations have a height of 20 mils, then teeth 13 may project roughly 20/4=5 mils above the surface of the top of outer leg 9 or 3.

It will be seen that I have accomplished the objects of my invention. The outer leg of the lower member is provided with an outwardly extending lip or an outward cant. The outer depending leg of the upper member is deflected inwardly to secure the assembly, ensuring that such outer leg of the upper member moves to a decreased periphery which increases its thickness and strength. The inner upstanding leg of the lower member is not provided with an inwardly directed lip or inwardly directed cant since this would require that the inner depending leg of the upper member be deflected outwardly, increasing its periphery and reducing its thickness and strength. Instead, gripping at the inner leg of the lower member is secured by upwardly extending serrations so that even thin coverings are securely held at the inside periphery of the buckle. By causing the peaks of the serrations to extend slightly above the plane or surface of the top of the outside leg, gripping of the covering is ensured while obviating distortion in the top of the upper member.

It will be understood that certain features and subcombinations are of utility and may be employed without reference to other features and subcombinations. This is contemplated by and is within the scope of the claims. It is further obvious that various changes may be made in details within the scope of the claims without departing from the spirit of the invention. It is therefore to be understood that the invention is not to be limited to the specific details shown and described.

Having thus described the invention, what is claimed is:

1. A covered buckle including in combination an annular upper member having a cross-section in the general shape of an inverted U, said upper member defining an outer peripheral depending leg and an inner peripheral depending leg, and a lower annular member having a generally U-shaped cross-section and comprising a generally upstanding outer peripheral leg and an upstanding inner peripheral leg provided at its top with upstanding serrations, wherein the lower member is telescoped within the upper member when said covered buckle is assembled.

2. A covered buckle as in claim 1 wherein the outer peripheral leg is upstanding and is provided at its top with an outwardly extending peripheral lip.

3. A buckle as in claim 2 wherein the amplitude of the serrations from trough to peak is of the same order of magnitude as the outward extension of said lip.

4. A buckle as in claim 2 wherein the outer peripheral leg is generally upstanding but is canted outwardly.

5. A buckle as in claim 4 wherein the amplitude of the serrations from trough to peak is of the same order of magnitude as said outward cant.

6. A buckle as in claim 1 wherein the serrations have generally the shape of a sawtooth.

7. A covered buckle as in claim 1 in which the upper member is shaped so that when covered by a covering having a certain thickness, the amplitude of the serrations from trough to peak is of the same order of magnitude as said thickness.

8. A buckle as in claim 1 wherein the top of the outer leg generally lies on a surface and in which the peaks of the serrations lie substantially on the same surface.

9. A buckle as in claim 1 wherein the top of the outer leg generally lies on a first surface, wherein the peaks of the serrations lie substantially on a second surface, and wherein the second surface is above the first surface.

10. A buckle as in claim 9 wherein the distance between the first and second surfaces is between approximately one-half and approximately one-tenth the amplitude of the serrations from trough to peak.

* * * * *

UNITED STATES PATENT AND TRADEMARK OFFICE

CERTIFICATE OF CORRECTION

PATENT NO. : 5,375,303

DATED : DECEMBER 27, 1994

INVENTOR(S) : RICHARD S. SHENIER

It is certified that error appears in the above-indentified patent and that said Letters Patent is hereby corrected as shown below:

Column 4, line 38:
IN CLAIM 4, PLEASE CHANGE "2" to — 1 —.

Signed and Sealed this

Seventeenth Day of October, 1995

*Attest:*

Bruce Lehman

BRUCE LEHMAN

*Attesting Officer*

*Commissioner of Patents and Trademarks*